US007891222B2

(12) United States Patent
Ratkus et al.

(10) Patent No.: US 7,891,222 B2
(45) Date of Patent: Feb. 22, 2011

(54) ELECTRONIC LOCKING SYSTEM

(75) Inventors: Jeffery R. Ratkus, Greensboro, NC (US); Rudor M. Teich, West Orange, NJ (US)

(73) Assignee: Hafele America Company, Archdale, NC (US)

( * ) Notice: Subject to any disclaimer, the term of this patent is extended or adjusted under 35 U.S.C. 154(b) by 303 days.

(21) Appl. No.: 11/451,540

(22) Filed: Jun. 12, 2006

(65) Prior Publication Data

US 2007/0283733 A1 Dec. 13, 2007

(51) Int. Cl.
*E05B 47/00* (2006.01)
*E05B 65/44* (2006.01)

(52) U.S. Cl. ..... 70/278.7; 70/78; 70/279.1

(58) Field of Classification Search ..... 70/78–82, 70/277, 278.1, 278.7, 279.1
See application file for complete search history.

(56) References Cited

U.S. PATENT DOCUMENTS 5,148,691 A * 9/1992 Wallden ..... 70/279.1
5,225,825 A 7/1993 Warren
5,257,860 A * 11/1993 Slivon ..... 70/78
5,385,039 A * 1/1995 Feldpausch et al. ..... 70/78
5,803,559 A 9/1998 Carlson et al.
5,805,074 A * 9/1998 Warren et al. ..... 70/78
5,820,234 A 10/1998 Capwell et al.
6,116,067 A * 9/2000 Myers et al. ..... 70/78
6,244,084 B1 * 6/2001 Warmack ..... 70/278.1
6,282,931 B1 * 9/2001 Padiak et al. ..... 70/279.1
6,347,848 B1 * 2/2002 Cho ..... 312/219
6,374,649 B1 4/2002 Holcomb et al.
6,698,258 B2 * 3/2004 Westwinkel ..... 70/78
6,722,167 B1 * 4/2004 Hsu ..... 70/78
6,739,164 B2 * 5/2004 Warmack ..... 70/257
6,746,091 B2 * 6/2004 Friar et al. ..... 312/218

(Continued)

FOREIGN PATENT DOCUMENTS

EP 383727 A1 * 8/1990

OTHER PUBLICATIONS

Dialock Hafele brochure entitled Furniture Locking Systems—Electric Furniture Locks, 2 pages, date unknown but believed to be prior art.

(Continued)

*Primary Examiner*—Suzanne D Barrett
*Assistant Examiner*—Christopher Boswell
(74) *Attorney, Agent, or Firm*—Womble Carlyle Sandridge & Rice, PLLC

(57) ABSTRACT

An electrically activated locking device is provided for use with an article of furniture of the type comprising a cabinet with an interior surface, at least one drawer in the cabinet moveable between an open position and a closed position, and a locking bar slideably mounted adjacent the interior surface for vertical movement and having at least one locking pin extending therefrom into locking engagement with the drawer and at least one lifting pin extending therefrom. The device includes an electrically powered actuator, an electronic module for controlling power to the actuator, a rotatable cam operatively connected to the actuator, and a lifting pin carrier in the path of and vertically moveable by rotation of the cam. The lifting pin carrier has an opening for receiving the lifting pin, whereby the locking bar is moveable into either an unlocked or locked position responsive to rotation of the cam.

19 Claims, 11 Drawing Sheets

U.S. PATENT DOCUMENTS

| | | | | |
|---|---|---|---|---|
| 7,009,490 | B2 | 3/2006 | Wong et al. | |
| 7,152,441 | B2 * | 12/2006 | Friar et al. | 70/78 |
| 7,373,795 | B2 * | 5/2008 | Kilbourne | 70/278.1 |
| 7,647,797 | B1 * | 1/2010 | Viso Cabrera et al. | 70/208 |
| 2007/0257773 | A1 * | 11/2007 | Hill et al. | 70/278.1 |

OTHER PUBLICATIONS

Security Door Controls brochure entitled SDC 290 Micro Cabinet Lock, 2 pages, dated 2004.

RCI Rutherford Controls brochure entitled Electric Locks, 2 pages, dated 2005.

Locknetics by Schlage brochure entitled 400 Series Electromechanical Locks, pp. E1 and E2, date unknown but believed to be prior art.

Door Control Systems brochure entitled Cabinet Locks, 4 pages, date unknown but believed to be prior art.

Hanchett Entry Systems, Inc. brochure entitled 610 Cabinet Lock, pp. 1 and 2, dated 2001.

Hanchett Entry Systems, Inc. brochure entitled 650 Series Electric Door Lock—Installation Instructions, pp. 1,2,3,4, dated 2001.

* cited by examiner

ELECTRONIC LOCKING SYSTEM

FIELD OF THE INVENTION

The present invention relates generally to locks for articles of furniture such as case goods or cabinets, and more particularly, to an electronic locking mechanism for cabinets with multiple drawers and the like, and also to the lock itself.

BACKGROUND OF THE INVENTION

Many types of locking systems are known for articles of furniture having one or more drawers, including desks, credenzas, file cabinets, and the like. Many of these articles are designed wherein drawers are configured in a stacked relationship. Often it is desirable to lock each of the drawers with a single locking system that is operable from a single location. The most common locking scheme is known as a "gang lock" and includes an elongated metal bar or rod that is mounted to an inside wall of the article of furniture for sliding, vertical movement between locked and unlocked positions. The bar or rod typically includes multiple locking or arresting pins that engage catches mounted on the individual drawers when the drawers are in the closed position and the bar or rod is in the locked position. When the bar or rod is in the unlocked position, the arresting pins are disengaged from the drawer catches, thereby permitting the drawers to be opened.

The vertical movement of the locking bar or rod have, in the past, been actuated by mechanical means. Mechanical actuators typically include a linkage or cable system that, when manually actuated, move the locking bar or rod between locked and unlocked positions. The actuator is often operated manually using a mechanical keyed locking mechanism. While such purely mechanical locking systems are effective in securely locking multiple drawers, they require a mechanical key which may be lost or misplaced. Also, where multiple cabinets or desks, for example, are used in a single location, multiple keys are required or else each cabinet or desk must be similarly keyed at considerable expense. Further, such systems cannot be remotely operated from one or more locations or automatically lock at a prescribed time, such as after hours.

More recently, some electronic keyless systems have been introduced which require no mechanical keys. Some of these systems employ an electric motor and cam configuration to actuate the vertical motion of a locking bar or rod. However, these systems are not compatible with the mechanical gang lock described herein above and involve design changes in conventional cabinet drawer construction.

Most of the electronic locking systems heretofore known also require considerable space for installation. This results in special additional compartments that must be constructed within the article of furniture for placement of the locking system.

SUMMARY OF THE INVENTION

One aspect of the present invention is directed to an article of furniture having a cabinet with an interior surface and multiple drawers in stacked relation. Each of the drawers is moveable between an open position and a closed position and dimensioned to create a space between the drawer and the interior surface of the cabinet when the drawer is in the closed position. A locking bar is slideably mounted for vertical movement in the interior space between the drawers and the cabinet wall. Multiple spaced apart locking pins are positioned on the locking bar for locking engagement with each of the drawers when the drawers are in the closed position. An electrically activated locking system is operatively connected to activate a lifting pin on the locking bar.

Another aspect of the present invention is an electrically activated locking device for use with an article of furniture having a cabinet structure with at least one drawer that is moveable between an open position and a closed position, and a locking bar that is slideably mounted to in the cabinet for vertical movement. The electrically activated locking device is dimensioned to fit in the space existing between the interior surface of the cabinet and the drawer when the drawer is in a closed position. The locking device includes an electrically powered actuator, or motor, an electronic module for controlling power to the actuator, and a rotatable cam that is operatively connected to the actuator. Rotation of the cam moves a lifting pin carrier that moves a lifting pin mounted on the locking bar, which in turn moves one or more locking pins into either an unlocked or locked position.

In one embodiment of the locking device, when external power is supplied to the lock, the actuator (motor) is powered and the cam is rotated until the cam has reached its apex where the locking bar and lifting pin are at their highest travel points. When external power is removed from the lock, energy that is stored in one or more capacitors will discharge to again operate the motor. The motor will rotate the cam only a few degrees whereupon the locking bar will return to its normal (lowest) position.

As a result of the lock configuration, it can be so installed to cause a downward motion of the locking bar when power is supplied to the lock.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1A:
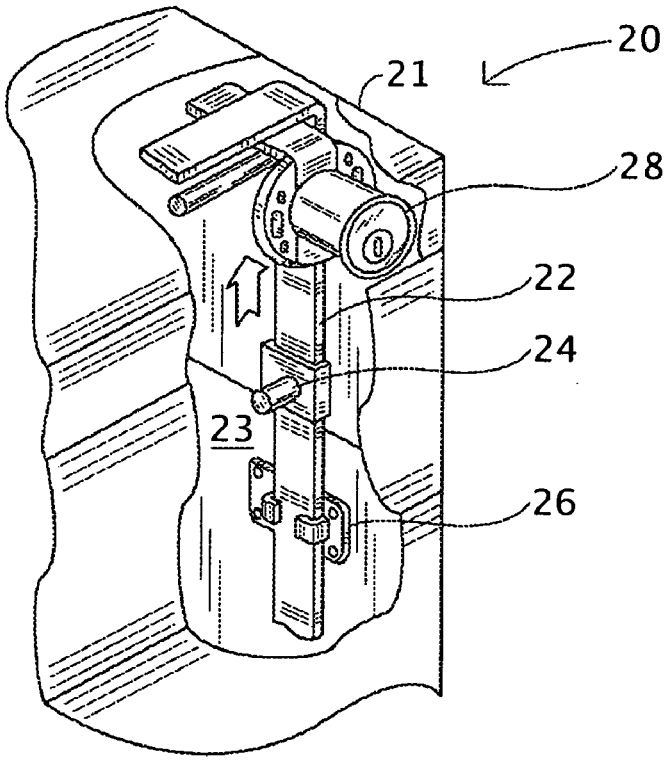
FIG. 1a (PRIOR ART)
FIGS. 1*a* through 3 are illustrative of prior art mechanical locking systems.
Figure 1B:
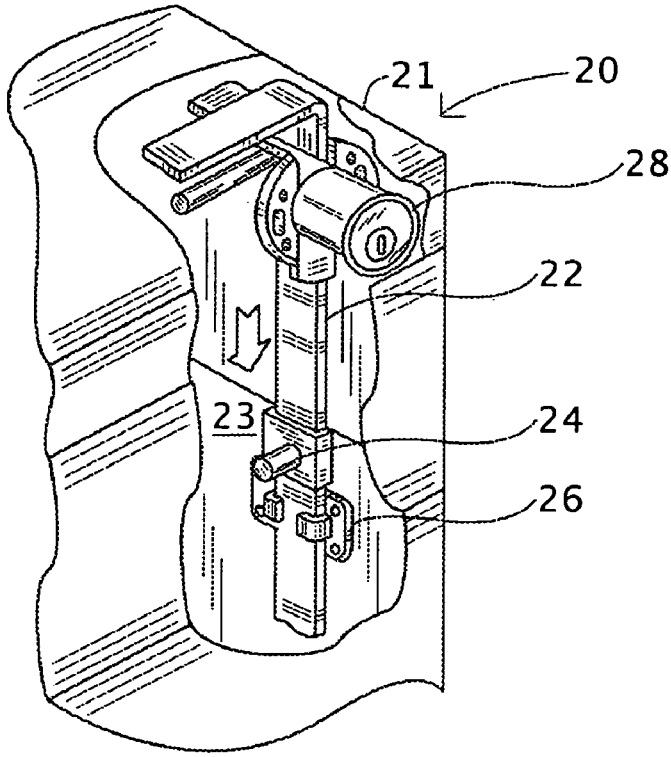
FIG. 1b (PRIOR ART)

The present invention is directed to a electronically activated locking device that addresses the problems described above.

Turning first to FIGS. 1*a* through 3, known designs and configurations 20, 40 are shown for locking a plurality of drawers with a single locking bar. These are commonly referred to as "gang lock" system. These systems include a locking bar 22 or locking rod 48 that is vertically mounted to an inside surface of a cabinet, desk, or the like 21, 42 having a plurality of drawers 30, 44, 45, 46. In the typical arrangement shown in FIGS. 1*a* and 1*b*, the locking bar 22 is movably mounted to the interior surface of the cabinet 21 by a plurality of guides 26 such that the locking bar 22 may slide vertically between a locked position (FIG. 1*a*) and an unlocked position (FIG. 1*b*).

Figure 2A:
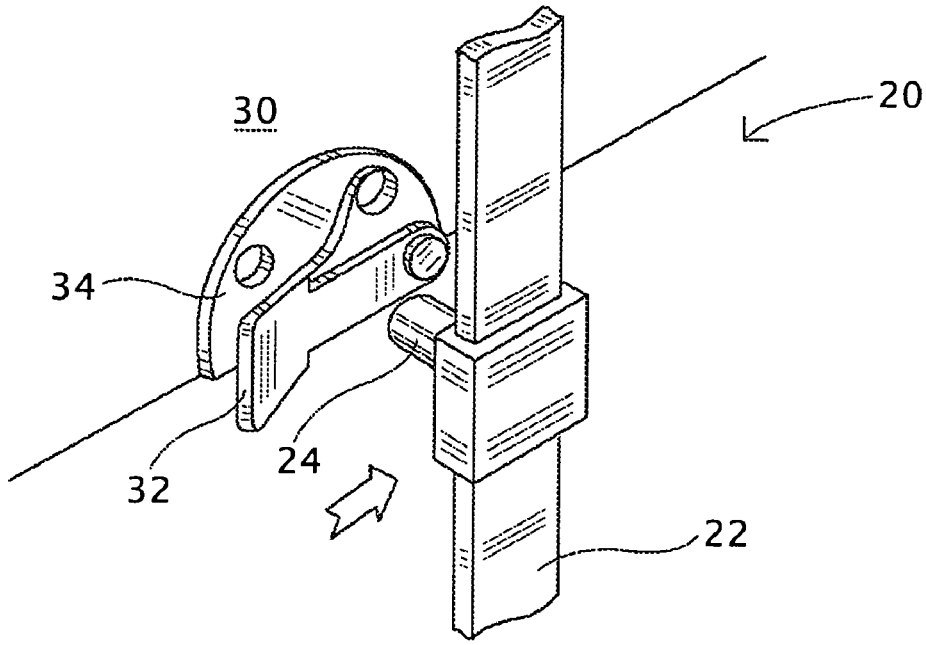
FIG. 2a (PRIOR ART)
Figure 2B:
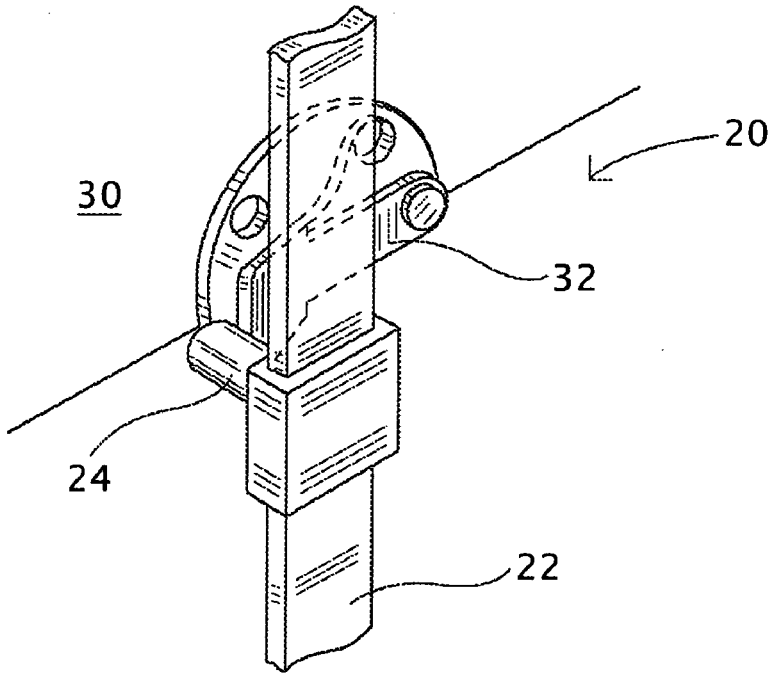
FIG. 2b (PRIOR ART)

The locking bar 22 further includes a plurality of locking, or arresting, pins 24. As shown in FIG. 2*a*, a catch 32 is typically pivotally mounted on each drawer surface 30 which is adjacent to the locking bar 22. As seen in FIG. 2*b*, when a drawer 30 is in a closed position, its associated arresting pin 24 engages the catch 32, thereby preventing the drawer 30 from being withdrawn when the locking bar 22 and the associated arresting pin 24 are in the locked position. The catch 32 is biased by a spring 34 or by gravity toward a locking position. This arrangement permits a drawer 30 to be closed even when the locking bar 22 is in a locked position, since the catch 32 will pivot and slide over the arresting pin 24 as the drawer 30 is closed. As the drawer is fully closed, the catch 32 snaps downwardly behind the arresting pin 24, thereby preventing the drawer 30 from being withdrawn until the locking bar 22 and corresponding arresting pin 24 are lowered to an unlocked position. As those skilled in the art will appreciate, the locking and unlocking scheme may be reversed so that the locking bar and arresting pin are lowered to locked position.

Figure 3:
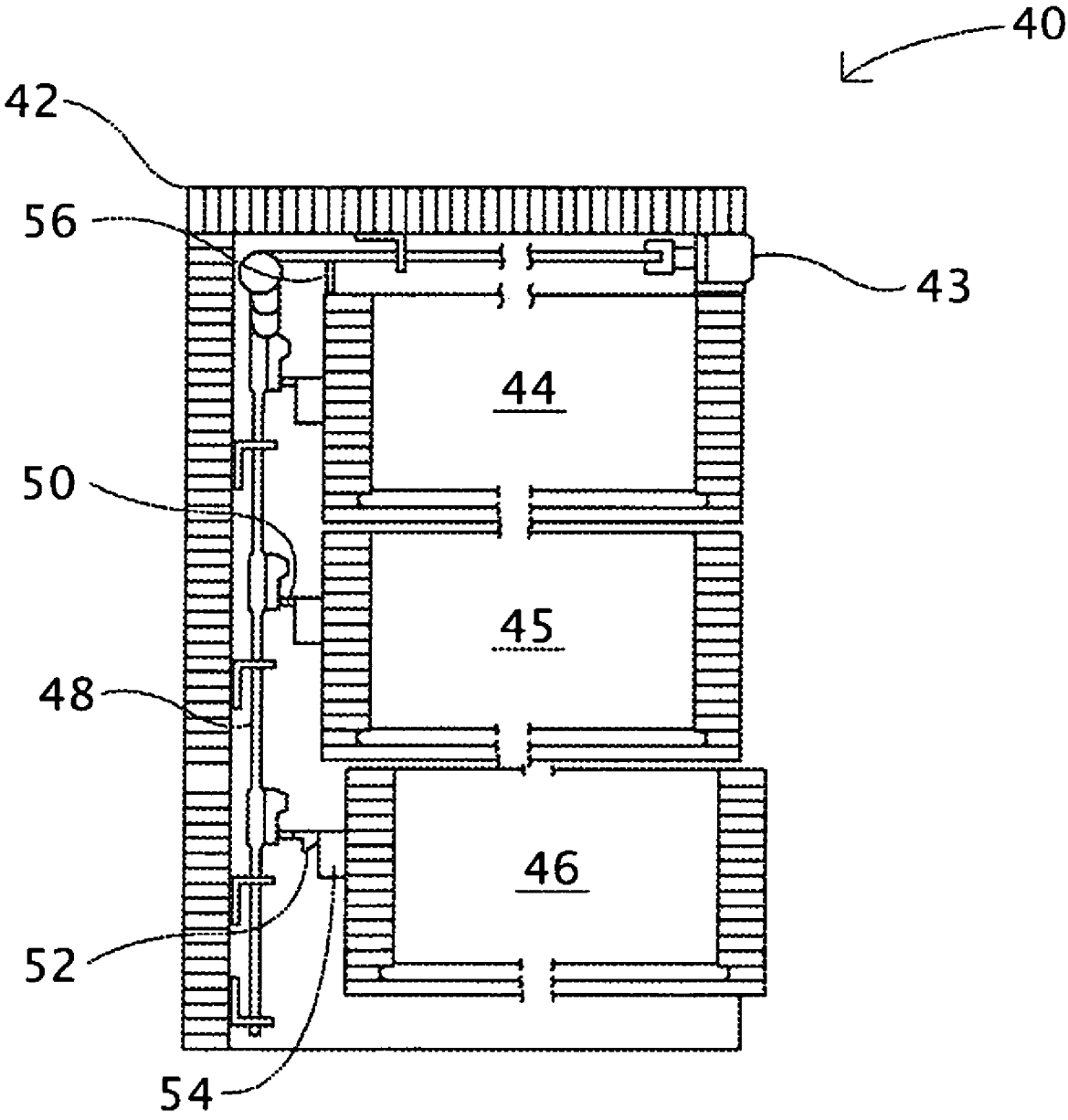
FIG. 3 (PRIOR ART)

Alternatively, as shown in FIG. 3, a locking bar or rod 48 may include a plurality of arresting hooks 50. In such an arrangement, each hook 50 engages a catch 54 on an associated drawer 44, 45, 46. The hooks 50 may be flexible or pivot to permit a drawer to be closed when the locking bar 48 and hooks are in a locked position. Alternatively, the locking bar or rod 48 may include a spring which biases the rod toward a locked position (not shown). In this arrangement, if a drawer is closed when the locking bar is in a locked position, a tapered edge on the hook 50 and/or drawer urges the rod and hooks to move toward the unlocked position. Once the drawer is in a closed position, the spring returns the bar to its locked position, thereby engaging the arresting hooks with the catches to lock the plurality of drawers.

Conventional gang-lock systems are commonly actuated between locked and unlocked positions by a keyed mechanism 28, 43, which operates to raise or lower the locking bar, generally through a lifting pin extending from the locking bar. Again, the locked position of the locking bars in such systems may be either up or down, depending on the placement of the arresting pins or hooks and their associates drawer catches.

The electrically activated locking system of the present invention is advantageous over known mechanical locking systems because it can be readily integrated into conventional gang-lock cabinet, desk, etc. designs, and with known electronic access systems, thus eliminating the need for mechanical keys to unlock the drawers. Such electronic access systems may provide access to drawers locked with the present invention by means of an electronic combination keypad, a magnetic card scanner, a radio frequency transponder, or the conventional electronic switch devices. One such electronic access system, for example, that can be used in conjunction with the present invention is the Dialock Furniture Terminal (DFT), available from Hafele GmbH & Company. Such electronic access systems also may permit simultaneous operation of multiple electrically activated gang locking systems from a single remote electronic access control module. Another advantage of the electrically activated locking system of the present invention is that it operates with minimal electric power consumption or heat dissipation.

Figure 4A:
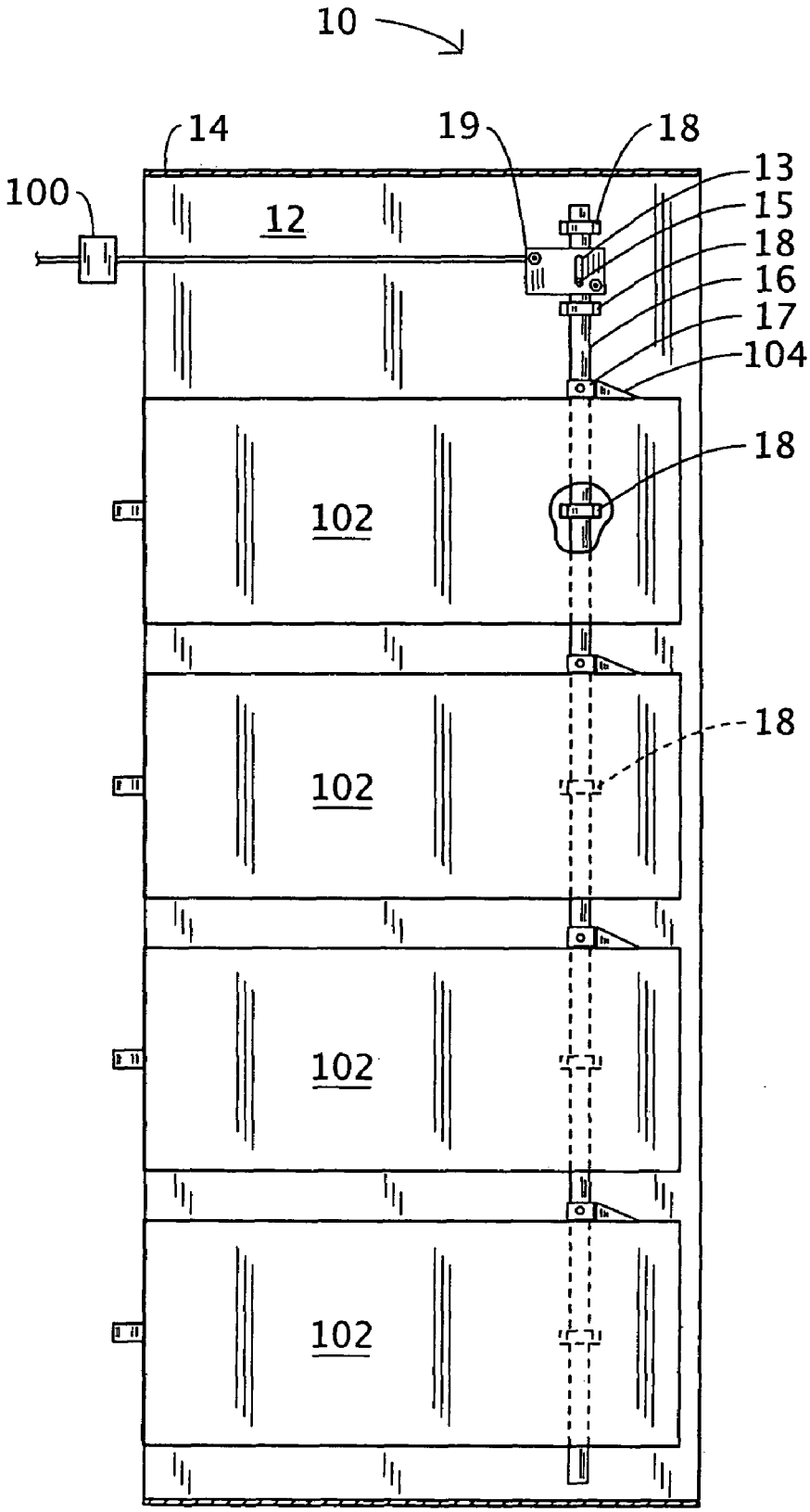
FIGS. 4*a* and 4*b* are schematic illustrations of one embodiment of the present invention showing a cabinet with a plurality of drawers in the locked and unlocked positions.
Figure 4B:
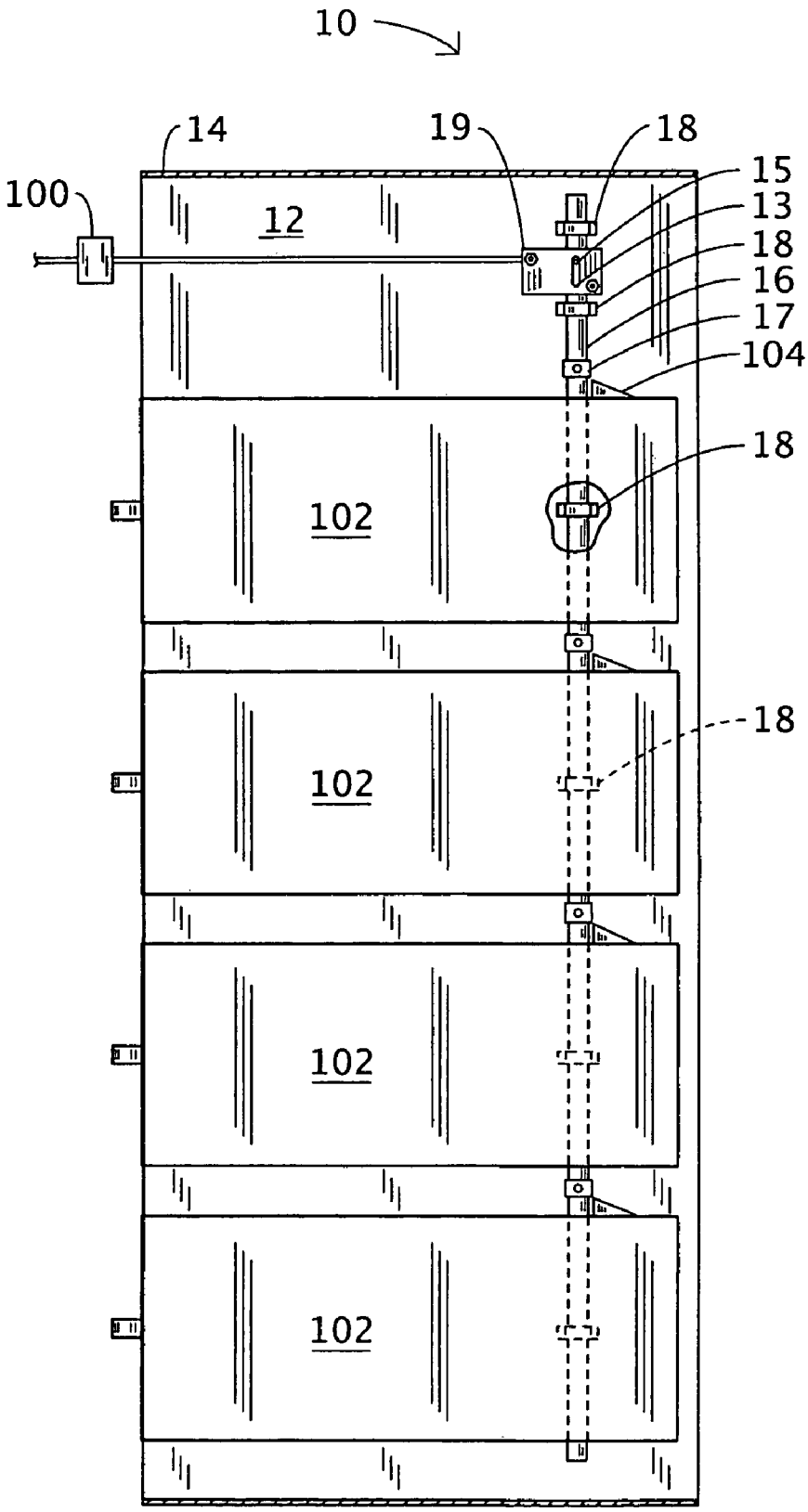

Turning now to FIGS. 4*a* and 4*b*, one aspect of the present invention is shown in simplified form. FIG. 4*a* is illustrative of the present invention in a locked position and FIG. 4*b* is illustrative of the present invention in an unlocked position. A rigid locking bar 16 is slidably mounted by a plurality of bar guides 18 to an interior surface 12 of a cabinet, desk, or the like 14 having a plurality of sliding drawers 102. Vertical movement of the locking bar 16 is affected by the electrically activated device 19, described in greater detail below, which is electrically interconnected to an external power source 100. The device 19, which is positioned over the locking bar 16, raises and lowers the locking bar 16 between unlocked and locked positions by raising or lowering a lifting pin 15 on the locking bar 16. A plurality of locking pins 17, that are also positioned on the locking bar 16 at spaced positions corresponding to the positions of the individual drawers, cooperate with corresponding catches 104 on the drawers 102.

Figure 5:
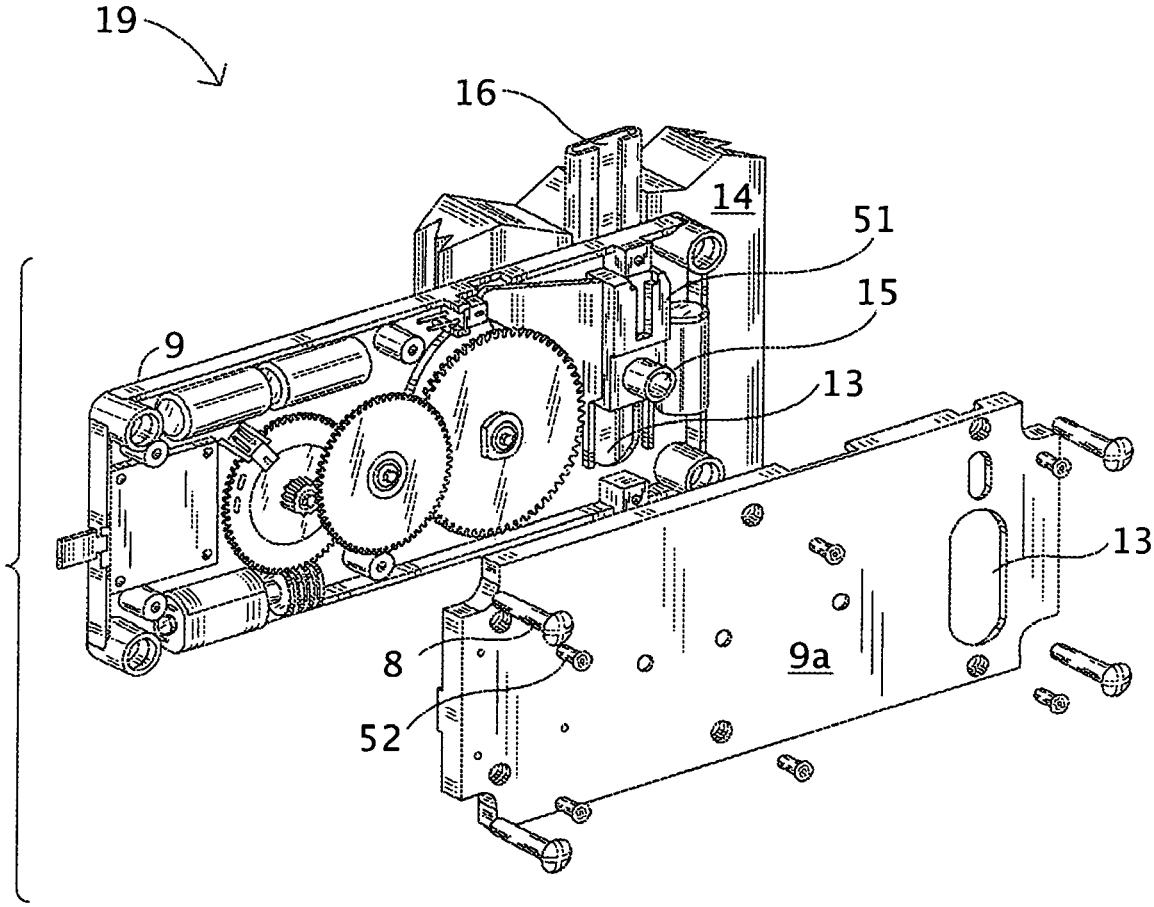
FIG. 5 is an exploded perspective view of the gang-lock system of FIGS. 4*a* and 4*b;*

As best seen in FIG. 5, the electrically activated device 19 includes a housing 9 which is mounted to an interior surface 14 of the cabinet by screws 8. The housing 9 is mounted over a portion of the locking bar 16. More particularly, the housing 9 for the device 19 has a thickness of less than about ½ inch so that it will fit within the ½ inch gap between the side of a drawer and interior of the cabinet that is typical in cabinet and drawer constructions. Thus, the typical cabinet does not have to be modified or enlarged for the device 19 of the present invention. As those skilled in the art will appreciate, the locking bar may be mounted in a recessed channel formed in the surface 14 of the cabinet, or the housing 9 may be formed to accommodate the clearance necessary when the locking bar is mounted directly to the interior surface 14. The lifting pin 15 on the locking bar 16 extends through the device 19 and through the vertical aperture 13 in the housing 9. A cover 9*a* likewise incorporates a vertical aperture 13 and is attached to the housing 9 by screws 52.

Figure 6:
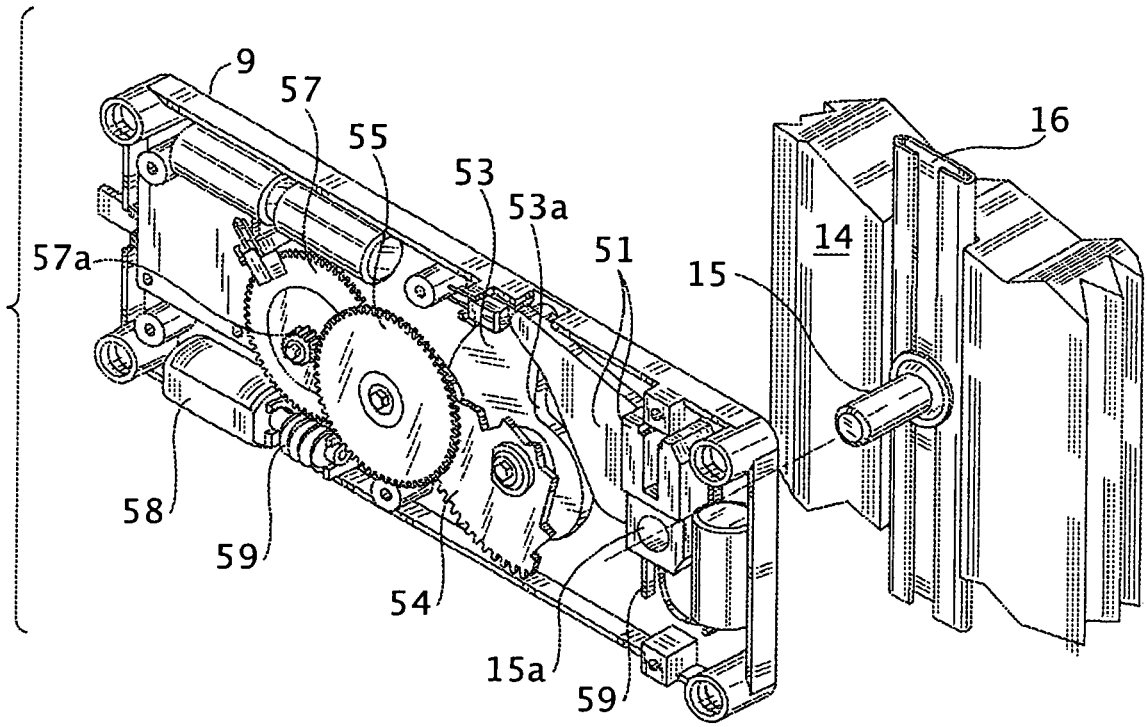
FIG. 6 is a detailed perspective view of the system of FIG. 5 illustrating the lifting mechanism of the system.
Figure 7:
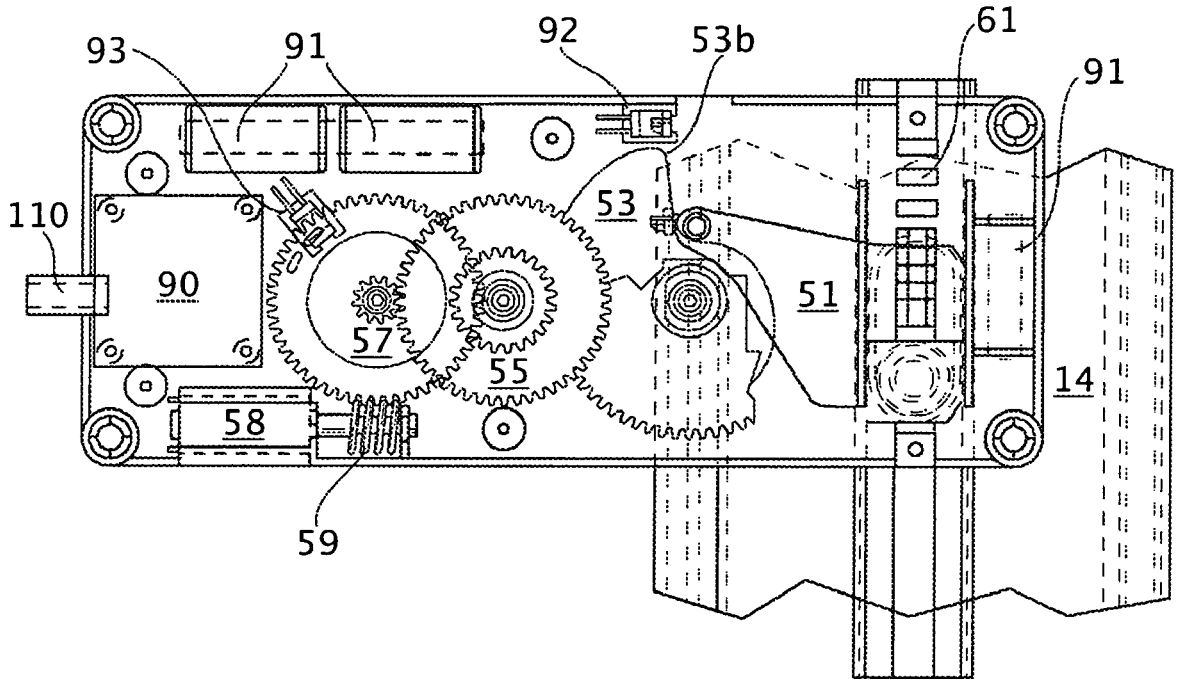
FIG. 7 is a front view of the gear train with the lifting pin trolley in the bottom position.
Figure 8:
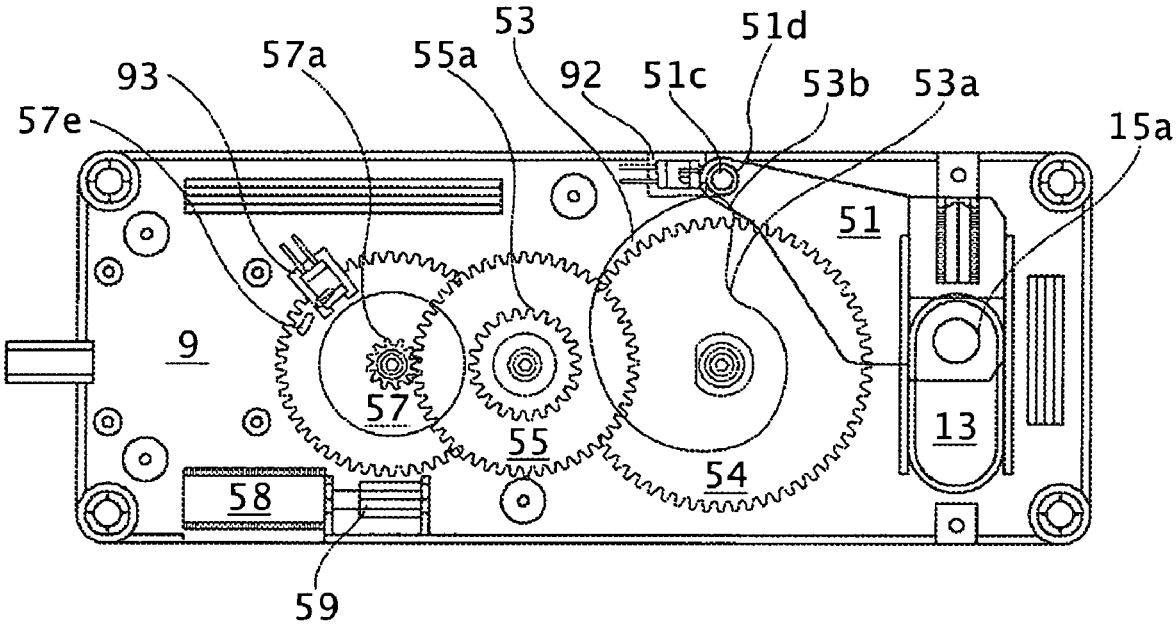
FIG. 8 is a front view of the gear train with the lifting pin trolley in the top position.

Referring to FIGS. 6 through 8, operation of the electrically activated device 19 of the present invention is illustrated. As best seen in FIG. 6, the lifting pin 15 which is attached to the locking bar 16 is captured in a lifting pin carrier or trolley 51 through a clearance aperture 15*a* corresponding to the shape of the lifting pin 15. The trolley 51 can slide vertically up and down a rail 59 that is integral to the housing 9. The trolley 51 is forced upwardly by the counterclockwise rotation of a cam 31. When the cam's surface 53*a* engages the arm of the trolley, the trolley, and thus the lifting pin 15, are at their lowest point. When the cam's surface 53*b* engages the arm of the trolley, the trolley 51 and pin 15 are at their highest point. As will be appreciated, the device 19 of the present invention may be mounted upside down, in which case references to the direction of travel of the trolley 51 and pin 15 are reversed with reference to the ground.

The cam 53 is rotated by an electric motor 58 through gears 59, 57, 57*a*, 54 55, and 55*a*. One purpose of this gear train is to reduce the rotational speed of the cam. In one embodiment, the compact motor 58 is Model No. FF-N20PN, available from Mabuchi Motor Co., Ltd., which rotates at about 10,000 rpm at a nominal load. The cam 53, however, must rotate at a substantially slower speed so that it can be stopped at a specified angle. Also, a speed-reducing gear train arrangement is needed since the motor alone provides inadequate torque to lift the weight of the locking bar 16 if the motor 58 were to drive the cam 53 directly. Thus, using a 1:N speed reduction provides a N:1 torque gain (less friction loss). In one embodiment, the gear train provides a 1:435 speed reduction.

The electrically activated device is configured to unlock, via the locking bar 16 and arresting pins 24, the plurality of drawers in the cabinet when external power supplied to the device 19. As described in greater detail below, control of the motor 58 is undertaken by an integral electronic module 90. Referring to FIG. 8, it is assumed that the device begins in the locked position, which corresponds to the cam 53 being in contact with the trolley at point 53*a*, and thus the trolley 51 being at its lowest point. When power is applied to the electronic module 90, the motor 58 is started to drive the gear train and rotate the cam 53 in a counterclockwise direction. The increasing radius of the cam pushes the trolley 51 are upwardly. When the cam 53 reaches the point where its surface 53*b* is in contact with the trolley 51 arm, the motor is stopped automatically.

When external power is removed, the electronic module, via energy stored in at least one capacitor, powers the motor 58 which rotates the cam 53 slightly counterclockwise again. As shown in the Figures, due to the steep slope of the cam 53, the trolley 51 drops to the lowest point after only a few degrees of rotation. The motor then is again stopped. The device 19 has now completed a complete cycle and returned to the locked position.

Turning to FIG. 7, the trolley 51 is biased against the cam 53 by means of a spring 61 which is housed within a channel in the trolley 51 and restrained by the housing 9 at one end. When the device 19 of the present invention is installed as shown in FIGS. 5 through 8, the weight of the locking bar 16 applies a downward force on the trolley 51 and thus against the cam 53. As the motor 58 rotates the cam 53 counterclockwise from it lowest point to raise the locking bar 16, the movement of the trolley 51 also compresses the spring 61. Thus, in this orientation, the spring 61 serves to bias the trolley in a locked position. If it is desired to mount the device 19 upside down, the spring 61 serves to overcome the weight of the bar 16, thus raising the bar. Without the spring 61, the bar would remain at a low point in reference to the ground, preventing contact between the cam and the trolley to raise or lower the bar.

Figure 9:
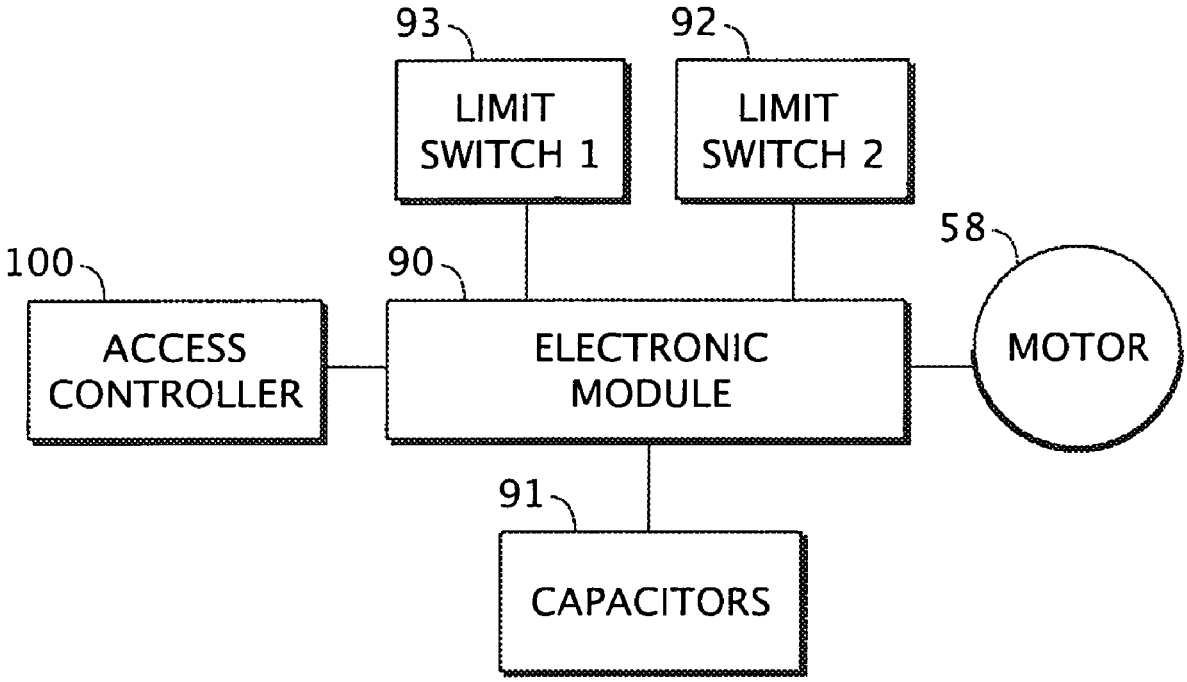
FIG. 9 is a block diagram of the electronic module and interconnections.

Referring to FIG. 9, the electronic module 90 is illustrated in greater detail. The electronic module 90 is mounted inside the housing 9 and is powered from an electronic access controller 100 as described above. Initial operation of the access controller 100 by a user supplies external power to the module 90 to unlock the drawers. When the user operates the access controller 100 to lock the drawers in the cabinet, external power is removed. In both cases, the electronic module 90 controls the power to the motor 58 to raise or lower the trolley 51.

The position of the cam 53 and the trolley 51 is more precisely determined by a pair of limit switches 92 and 93. Referring again to FIG. 8, at the end of the arm of the trolley 51 are a pin 51c and a sleeve 51d. The sleeve contacts the cam 53 and acts as a rotating bearing to reduce the friction between the cam 53 and the pin 51c which is pushed up by the cam as the cam rotates in its clockwise direction. Limit switch 92 is an interrupter-type opto-sensor. The output of the sensor changes when an opaque material is moved in close proximity to the sensor so as to block the IR beam in the sensor. As seen in FIG. 8, the edge of the trolley 51 obstructs the IR beam when the trolley is in its highest position. Thus the sensor 92, which is interconnected to the electronic module 90, communicates to the module 90 when the trolley has reached this upper position. The module 90 then immediately turns off power to the motor 58, thus stopping rotation of the cam. To further ensure that the cam is stopped and that the momentum of the inertia in the cam 53 is dissipated quickly, the electronic module 90 incorporates an electronic brake by applying a low resistance across the motor 58 in a fashion known in the art.

As will also be appreciated, tolerances in manufacturing and the need for clearances between the trolley 51 and the rail on which it travels, the precise position of the trolley 51 and cam 53 may not be sufficiently detected by sensor 92. For example, if the top of the trolley 51 is detected too early, the cam may stop short of its highest point. Subsequent operation of the motor 58 and rotation of the cam 53 may be insufficient to move the cam beyond surface 53b. The result would be that the locking bar 16 would be prevented from moving downwardly to lock the drawers. Likewise, if the cam 53 stops too late, the trolley 51 will return to its lowest point rather than at its highest point needed to unlock the drawers. For this reason, sensor 93 provides a fine position signal, complementing the coarse information transmitted by sensor 92. Sensor 93 straddles gear 57, its IR beam being blocked by the gear. A slot 57*e* in the gear, however, allows the IR beam to pass through the gear 57 when the slot 57*e* is aligned with the sensor 93. This arrangement permits the position of the gear 57 to be determined with a 2 to 3 degrees of rotation through the sensor 93. With a gear step-down between gears 57 and 54 of about 1:7 in one embodiment, the 2-3 degrees of tolerance in the position of gear 57 translates to less than a 1 degree tolerance on gear 54, and thus the cam 53. In operation, the electronic module 90 will stop the motor 58 only when it receives a signal from sensor 93 that corresponds to an unblocked IR beam, which will have been preceded by a signal from sensor 92 corresponding to a blocked IR beam.

As previously described, the electronic module 90 must power the motor 58 when external power to the module 90 has been removed. To move from an unlocked to a locked position, the motor is required to move the cam 53 only a few degrees to move the trolley from point 53*b* to point 53*a*. In one embodiment, the required rotation is less than 5 degrees. This corresponds to a time period of only about 0.1 seconds that the motor must be powered. The power to operate the motor and the module 90 while external power has been removed is obtained from at least one large value capacitor 91, shown in FIG. 9. The capacitor 91 is charged when external power is supplied to the module 90, and discharges when external power is removed. In one embodiment, capacitors with a combined value of 3,000 microfarads were found to provide adequate power to rotate the cam 53 to its low starting point.

Figure 10:
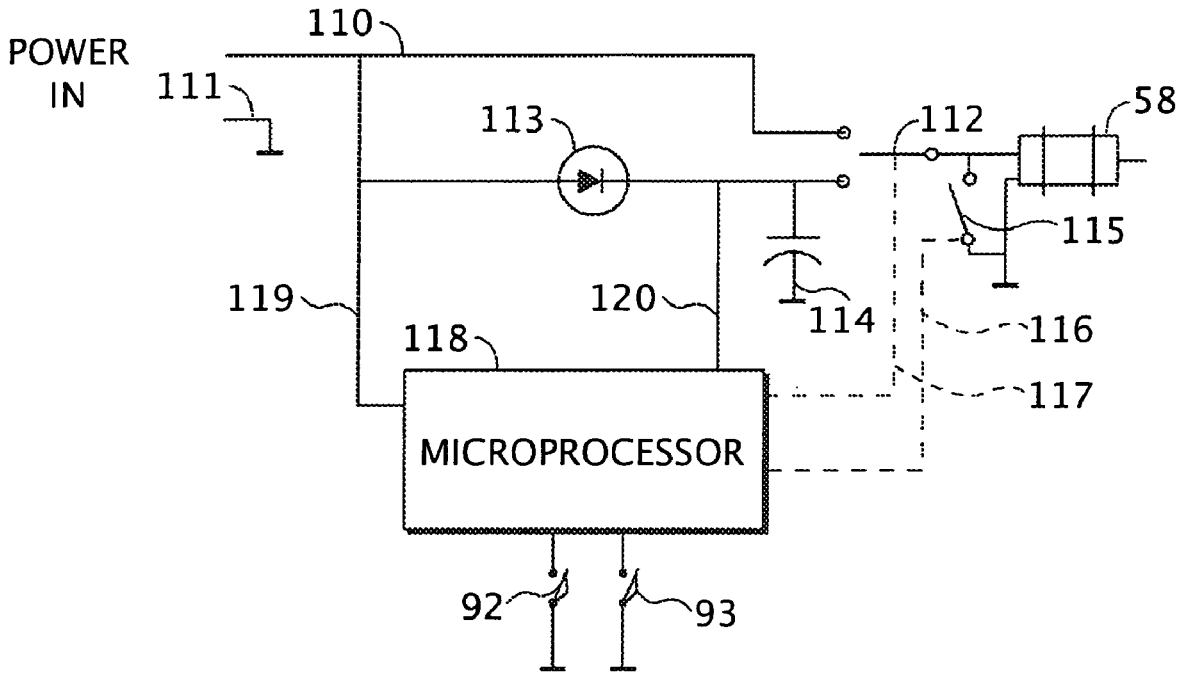
FIG. 10 is a simplified block diagram of the electronic module.

FIG. 10 provides a simplified block diagram of the electronic module 90. External power (voltage) is supplied through wires 110 and 111 from the access controller (not shown). The incoming voltage is provided to capacitor 114 through a diode 113. The voltage on capacitor 114 powers a microprocessor 118. The microprocessor 118 checks the state of the inputs from limit switches/sensors 92 and 93. If the input indicates that the cam 53 is not in the top position, the microprocessor powers an electronic switch 112 through circuit 117 and connects the motor 58 to the supply voltage 110, 111.

When limit switches 92 and 93 indicate that the cam 53 has reached its peak position, switch 112 is returned to its middle position, thus disconnecting the power from the motor. Immediately afterwards, switch 115 is closed through circuit 116. The closed switch 115 acts as a short across the motor 58, which acts to brake the motor. The cam 53 then comes to a stop at its upper position and the locking bar 16 is in its unlocked position. Switch 115 is then released to minimize the power consumption of the device 119 so that it remains in the unlocked position as long as external power is connected.

When external power is removed from the electronic module 90, the microprocessor 118 detects the loss of power through circuit 119. The microprocessor remains powered by capacitor 114 which is prevented from being discharged into input 110, 111 through diode 113. The microprocessor activates switch 112 so that motor 58 is connected to capacitor 114. The motor discharges the capacitor as it rotates and returns the cam 53 to its starting low point. When the capacitor is discharged, the microprocessor 118 powers down and the device 119 becomes dormant until external power is again supplied to the electronic module 90.

In the embodiments described above, drawers are locked when the locking bar 16 and arresting pins 17 are in a fully downward position, as shown in FIG. 4. Accordingly, the arresting pins 15 engage catches 104 on the drawers 102 when the drawers are fully closed, and lock the drawers when external power is removed from the electronic module 90. Conversely, drawers are unlocked when external power is supplied to the electronic module 90 and the arresting pins 17 are in a fully upward position. This "fail locked" arrangement ensures that the drawers will be locked if power is inadvertently lost. Alternatively, the locking system and device 19 described above may be installed as a "fail unlocked" system. This can be achieved by installing the device 19 upside down so that its cover 9*a* is in contact with the interior surface 14 of the cabinet. In this position, applying power to the electronic module 90 will force the trolley 51 downwardly, thus locking the cabinet. When external power is removed, the trolley 51 will rise to its highest position with respect to the ground, and the cabinet will become unlocked.

The locking system described herein can be readily combined with known drawer interlock systems which prevent more than one drawer in a stack of drawers from being withdrawn when the drawers are unlocked. Further, multiple gang locks can be included in a single cabinet, desk, or the like which include more than one stack of drawers. Each of the multiple gang locks may be operable from a single electronic access module, or each may be separately controlled.

Although the present invention has been described by reference to a preferred embodiment, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. An electrically activated locking device for use with an article of furniture selected from the group consisting of file cabinets, desks, and credenzas, each of which comprises a cabinet with side walls, a rear wall and a front, at least one drawer mounted in the front of the cabinet and moveable between an open position and a closed position, and a locking bar slideably mounted to one of the cabinet walls adjacent the interior surface thereof for vertical movement in the space between the one side wall of the cabinet and the adjacent side wall of the at least one drawer for the purpose of locking and unlocking, the locking bar having at least one locking member extending therefrom into locking engagement with the at least one drawer and a lifting pin extending therefrom, the locking device comprising:

(a) an electrically powered actuator having an output shaft with a worm gear thereon;

(b) a rotatable drop cam operatively connected to the actuator and having a peripheral edge;

(c) a trolley in contact with the peripheral edge and vertically moveable by rotation of the cam, the trolley being operationally connected to the locking bar, whereby the locking bar is moveable into one of an unlocked and locked position responsive to rotation of the cam;

(d) a speed reducing gear train comprising a plurality of gears having teeth on the periphery thereof operatively connecting the electronically powered actuator and the rotatable cam to increase the torque necessary to lift the locking bar, the worm gear of the output shaft of the electrically powered actuator operatively engaging the peripheral teeth of one of the gears; and (e) the trolley, the electrically powered actuator, the output shaft of the electrically powered actuator, the gears of the speed reducing gear train, and the rotatable cam located in the limited space between one side wall of the cabinet and the adjacent side wall of the at least one drawer and the output shaft of the electrically powered actuator, and the gears of the speed reducing gear train and the rotatable cam being arranged in and moving in planes generally parallel to the cabinet side wall and adjacent drawer side wall.

2. The device of claim 1 wherein the actuator is an electric motor.

3. The device of claim 1 and further including an electronic module configured to power the actuator upon receipt of electric power from an external power source, and wherein the actuator rotates the cam to move the locking bar into one of an unlocked and locked position.

4. The device of claim 3 further comprising a protection mechanism for automatically removing power to the actuator when the locking bar reaches one of the unlocked and locked first position, comprising:

(a) at least one limit switch for detecting when the locking bar is in the first position, the limit switch electrically interconnected to the electronic module, and (b) wherein when the locking bar is the first position, the limit switch is configured to transmit a signal to the electronic module to stop power to the actuator.

5. The device of claim 1 and further including an electronic module is configured to power the actuator upon removal of electric power from an external power source, and wherein the actuator rotates the cam to move the locking bar into one of an unlocked and locked second position.

6. The device of claim 5 further comprising at least one capacitor electrically interconnectable to the electronic module, wherein when external power is removed the capacitor powers the electronic module to control power to the actuator to rotate the cam wherein the locking bar is moved into the locked position.

7. An electrically activated locking system for use with an article of furniture selected from the group consisting of the file cabinets, desks, and credenzas, each of which comprises a cabinet with side walls, a rear wall and a front, and at least one drawer mounted in the front of the cabinet and moveable between an open position and a closed position, comprising:

(a) a locking bar configured to slideably mount to the interior surface of one of the cabinet side walls thereof for vertical movement, the locking bar further comprising at least one locking member configured for locking engagement with at least one drawer;

(b) an electrically powered actuator having an output shaft with a worm gear thereon;

(c) a rotatable drop cam operatively connected to the actuator and having a peripheral edge;

(d) a trolley in contact with the peripheral edge and vertically moveable by rotation of the cam, the trolley being operatively connected to the locking bar to move the locking bar into one of an unlocked and locked position responsive to rotation of the cam;

(e) a speed reducing gear train comprising a plurality of gears operatively connecting the electronically powered actuator and the rotatable cam to increase the torque necessary to lift the locking bar, the worm gear of the output shaft of the electrically powered actuator operatively engaging the peripheral teeth of one of the gears; and (f) the trolley, the electrically powered actuator, the output shaft of the electrically powered actuator, the gears of the speed reducing gear train, and the rotatable cam located in the space between one side wall of the cabinet and the adjacent side wall of the at least one drawer and the output shaft of the electrically powered actuator, the gears of the speed reducing gear train, and the rotatable cam being arranged in and moving in planes generally parallel to the cabinet side wall and adjacent drawer side wall.

8. The device of claim 7 wherein the actuator is an electric motor.

9. The device of claim 7 and further including an electronic module configured to power the actuator upon receipt of electric power from an external power source, and wherein the actuator rotates the cam to move the locking bar into one of an unlocked and locked first position.

10. The device of claim 9 further comprising a protection mechanism for automatically removing power to the actuator when the locking bar reaches one of the unlocked and locked first position, comprising:

(a) at least one limit switch for detecting when the locking bar is in the first position, the limit switch electrically interconnected to the electronic module, and (b) wherein when the locking bar is the first position, the limit switch is configured to transmit a signal to the electronic module to stop power to the actuator.

11. The device of claim 7 and further including an electronic module configured to power the actuator upon removal of electric power from an external power source, and wherein the actuator rotates the cam to move the locking bar into one of an unlocked and locked second position.

12. The device of claim 11 further comprising at least one capacitor electrically interconnectable to the electronic module, wherein when external power is removed the capacitor powers the electronic module to control power to the actuator to rotate the cam wherein the locking bar is moved into the locked position.

13. The device of claim 7 further comprising a plurality of spaced apart locking pins positioned on the locking bar for locking engagement with a plurality of drawers.

14. An article of furniture, selected from the group consisting of file cabinets, desks, and credenzas, comprising:

(a) a cabinet having side walls, a rear wall, and a front;

(b) a plurality of drawers arranged in the front of the cabinet, each of the drawers moveable between an open position and a closed position and dimensioned to create a limited space between a side wall of each drawer and the interior adjacent surface of a side wall of the cabinet when a drawer is in the closed position;

(c) a catch mounted on the side wall of each drawer;

(d) a locking bar slideably mounted to the interior surface of one of the cabinet side walls for vertical movement in the space between the side walls of the drawers and the interior surface of the sidewall of the cabinet;

(e) a plurality of spaced apart locking members positioned on the locking bar, each locking member moveable between a first position in locking engagement with a catch on one of the plurality of drawers when the drawers are in the closed position and a second position removed from engagement with the catch;

(f) an electrically activated locking device mounted in the limited space between the side wall of the drawers and the interior surface of the side wall of the cabinet operatively connected to the locking bar and comprising;

(i) an electrically powered actuator having an output shaft with a worm gear thereon;

(ii) a rotatable drop cam operatively connected to the actuator and having a peripheral edge;

(iii) a trolley in contact with the peripheral edge and vertically moveable by rotation of the cam, the trolley being operationally connected to the locking bar, whereby the locking bar is moveable into one of an unlocked and locked position responsive to rotation of the cam;

(iv) a speed reducing gear train comprising a plurality of gears having teeth on the periphery thereof operatively connecting the electronically powered actuator and the rotatable cam to increase the torque necessary to lift the locking bar, the worm gear of the output shaft of the electrically powered actuator operatively engaging the peripheral teeth of one of the gears; and (v) the trolley, the electrically powered actuator, the output shaft of the electrically powered actuator, the gears of the speed reducing gear train, and the rotatable cam located in the space between one side wall of the cabinet and the adjacent side wall of the at least one drawer and the output shaft of the electrically powered actuator, the gears of the speed reducing gear train, and the rotatable cam being arranged in and moving in planes generally parallel to the cabinet side wall and adjacent drawer side wall.

15. The article of claim 14 wherein the actuator is an electric motor.

16. The article of claim 14 and further including an electronic module is configured to power the actuator upon receipt of electric power from an external power source, and wherein the actuator rotates the cam to move the locking bar into one of an unlocked and locked first position.

17. The article of claim 16 further comprising a protection mechanism for automatically removing power to the actuator when the locking bar reaches one of the unlocked and locked first position, comprising:

(a) at least one limit switch for detecting when the locking bar is in the first position, the limit switch electrically interconnected to the electronic module, and (b) wherein when the locking bar is the first position, the limit switch is configured to transmit a signal to the electronic module to stop power to the actuator.

18. The article of claim 14 and further including an electronic module is configured to power the actuator upon removal of electric power from an external power source, and wherein the actuator rotates the cam to move the locking bar into one of an unlocked and locked second position.

19. The article of claim 18 further comprising at least one capacitor electrically interconnectable to the electronic module, wherein when external power is removed the capacitor powers the electronic module to control power to the actuator to rotate the cam wherein the locking bar is moved into the locked position.

* * * * *